US007299720B1

(12) United States Patent
Schultz et al.

(10) Patent No.: US 7,299,720 B1
(45) Date of Patent: Nov. 27, 2007

(54) REVERSIBLE RATCHET WRENCH

(75) Inventors: George W. Schultz, Bristol, WI (US); Billy J. Burkes, Pleasant Prairie, WI (US); Richard L. Hopper, Jr., Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 11/335,962

(22) Filed: Jan. 20, 2006

(51) Int. Cl.
*B25B 13/46* (2006.01)
*B25B 33/00* (2006.01)

(52) U.S. Cl. ..... 81/63.1; 81/62

(58) Field of Classification Search ..... 81/62, 81/63.1

See application file for complete search history.

(56) References Cited

U.S. PATENT DOCUMENTS

| | | | | |
|---|---|---|---|---|
| 2,202,402 | A * | 5/1940 | Rueb | 192/43.1 |
| 2,803,980 | A * | 8/1957 | Vogel | 81/62 |
| 2,981,389 | A | 4/1961 | Kilness | |
| 3,290,969 | A | 12/1966 | Bergquist et al. | |
| 3,467,231 | A | 9/1969 | Haznar | |
| 3,654,975 | A | 4/1972 | Ballsmith et al. | |
| 3,859,869 | A | 1/1975 | Pasbrig | |
| 4,466,523 | A | 8/1984 | DeCarolis et al. | |
| 4,497,227 | A | 2/1985 | Stasiek | |
| 4,520,697 | A | 6/1985 | Moetteli | |
| 4,807,500 | A | 2/1989 | Main | |
| 5,174,176 | A * | 12/1992 | Krivec | 81/63.1 |
| 6,260,448 | B1 | 7/2001 | Chaconas | |
| 6,279,428 | B1 * | 8/2001 | Huang | 81/63.1 |
| 6,513,409 | B1 | 2/2003 | Lee | |
| 6,584,875 | B1 * | 7/2003 | Deng | 81/63.1 |
| 6,691,594 | B2 * | 2/2004 | Chen | 81/61 |
| 6,711,973 | B2 | 3/2004 | Arnold et al. | |
| 6,851,334 | B2 * | 2/2005 | Hsien | 81/63.1 |
| 6,857,339 | B2 * | 2/2005 | Chen | 81/63.1 |
| 6,948,605 | B1 | 9/2005 | Gauthier | |
| 6,964,216 | B2 * | 11/2005 | Chen | 81/63.1 |
| 6,971,285 | B2 * | 12/2005 | Chen | 81/63.1 |
| 7,080,579 | B2 * | 7/2006 | Chen | 81/63.1 |
| 7,082,859 | B2 * | 8/2006 | Huang | 81/62 |
| 7,089,830 | B2 * | 8/2006 | Hu | 81/63.1 |
| 7,111,527 | B1 * | 9/2006 | Lee | 81/63.1 |
| 7,124,664 | B1 * | 10/2006 | Lee | 81/63.1 |
| 2004/0003684 | A1 * | 1/2004 | Chen | 81/62 |
| 2004/0177725 | A1 * | 9/2004 | Shih-Yueh | 81/63.1 |
| 2004/0200321 | A1 * | 10/2004 | Chen | 81/63.1 |
| 2004/0216564 | A1 * | 11/2004 | Chen | 81/63.1 |
| 2004/0237727 | A1 * | 12/2004 | Huang | 81/62 |

(Continued)

*Primary Examiner*—David B Thomas
(74) *Attorney, Agent, or Firm*—Seyfarth Shaw LLP

(57) ABSTRACT

A reversible ratchet including a ratchet body having a drive member for applying torque to a workpiece. The ratchet body defining a receptacle and a ratchet assembly disposed in the receptacle. The ratchet assembly including a rotatable gear, a first pawl and a second pawl, where the first and second pawls are engageable with the gear. The ratchet includes a reverse lever coupled to the first and second pawls and movable between a first position and a second position. The first pawl engaging the gear in the first position of the reverse lever, and the second pawl engaging the gear in the second position of the reverse lever. The ratchet also includes a cover plate connected to the ratchet body. The cover plate includes a spacer that engages the reverse lever to allow movement of the reverse lever substantially only between the first and second positions.

18 Claims, 8 Drawing Sheets

U.S. PATENT DOCUMENTS

2004/0261584 A1* 12/2004 Huang ..... 81/63.1
2005/0092135 A1* 5/2005 Chen ..... 81/63.1
2005/0092136 A1* 5/2005 Chen ..... 81/63.1
2006/0117913 A1* 6/2006 Chen ..... 81/63.1

* cited by examiner

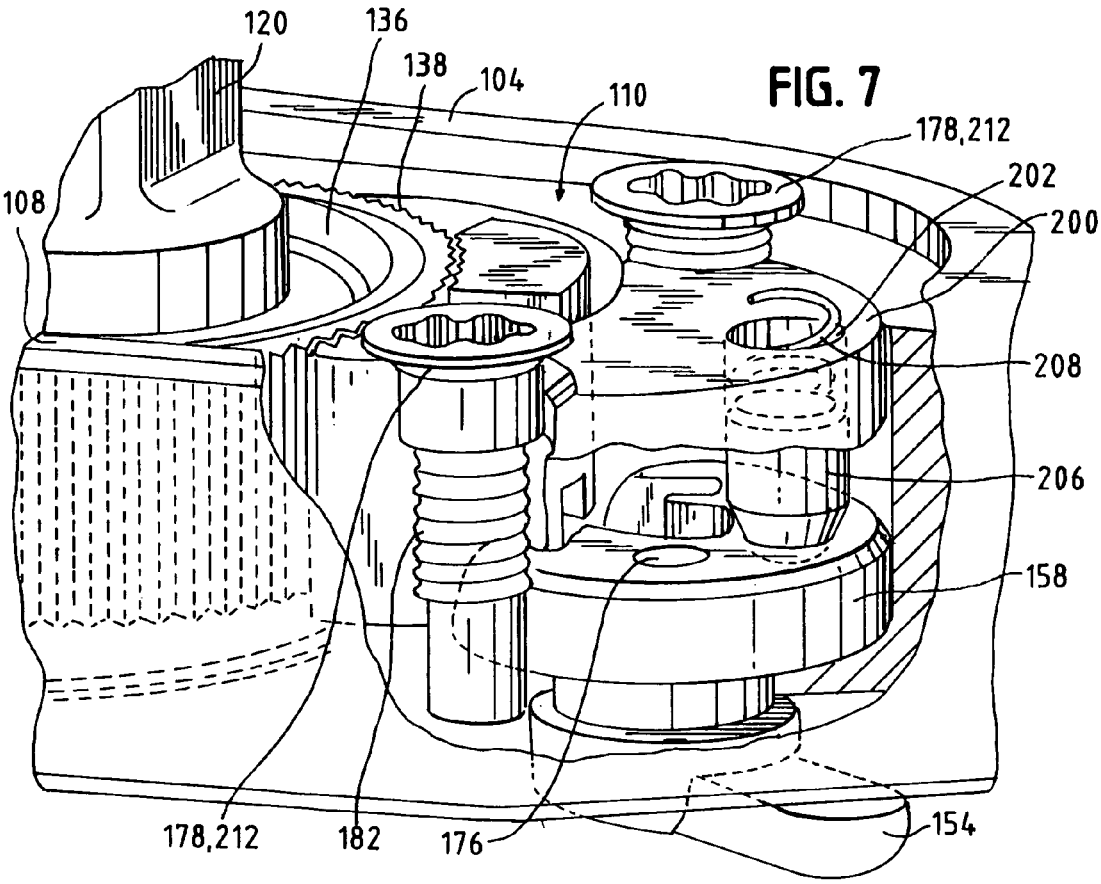
FIG. 7
FIG. 8
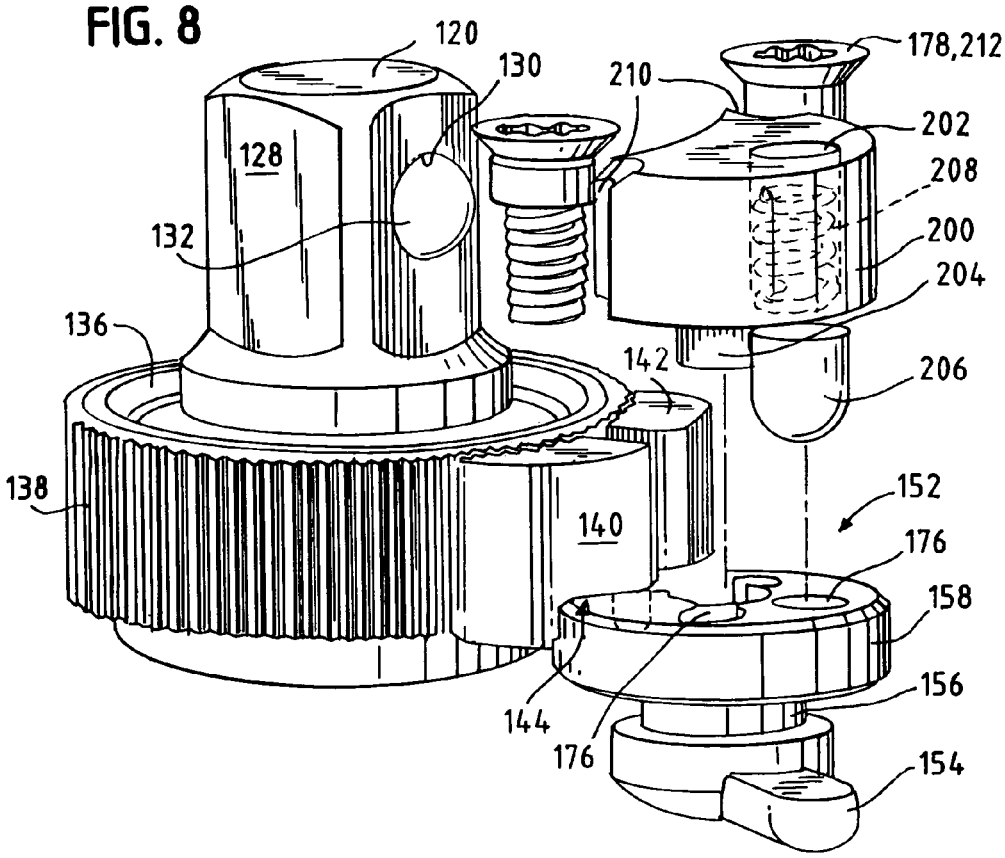

REVERSIBLE RATCHET WRENCH

BACKGROUND

Ratchet devices such as ratchet wrenches are used to apply a torque to a workpiece. For example, ratchet wrenches are used to apply a torque to a bolt to rotate and tighten the bolt to a workpiece. Such ratchet wrenches include several working parts which must be machined and inserted into the wrench. These wrenches have limited space and tight tolerances. Therefore, it is difficult to machine and manufacture these wrenches. Additionally, manufacturing costs for making the ratchet wrenches are relatively high because of the number of intricate parts needed to assemble these wrenches.

Accordingly, there is a need for a ratchet device that has less parts and that is easier to machine and assemble.

SUMMARY

The application is directed to a ratchet and more specifically, to a ratchet wrench having a manually operated reverse lever and a spacer which maintains the reverse lever in position in the ratchet.

One embodiment provides a reversible ratchet including a ratchet body having a drive member for applying torque to a workpiece. The ratchet body defines a receptacle and a ratchet assembly disposed in the receptacle. The ratchet assembly includes a rotatable gear, a first pawl and a second pawl, where the first and second pawls are engageable with the gear. The ratchet includes a reverse lever coupled to the first and second pawls and movable between a first position and a second position. The first pawl engaging the gear in the first position of the reverse lever, and the second pawl engaging the gear in the second position of the reverse lever. The ratchet also includes a cover plate connected to the ratchet body. The cover plate includes a spacer that engages the reverse lever to allow movement of the reverse lever substantially only between the first and second positions.

Another embodiment provides a reversible ratchet including a ratchet body having a drive member for applying torque to a workpiece. The ratchet body includes a peripheral wall structure defining a receptacle. The ratchet includes a rotatable gear positioned in the receptacle, where the gear defines a plurality of gear teeth. The ratchet also includes a first pawl and a second pawl positioned adjacent to the gear in the receptacle. Each of the first and second pawls are pivotably connected to the ratchet body and include a plurality of pawl teeth adapted to matingly engage the gear teeth. The ratchet includes a reverse lever coupled to the first and second pawls. The reverse lever is movable between a first position and a second position, where the first pawl engages the gear in the first position of the reverse lever, and the second pawl engages the gear in a second position of the reverse lever. The ratchet also includes a cover plate connected to the ratchet body and a spacer positioned between the cover plate and the reverse lever. The spacer engages the reverse lever to allow movement of the reverse lever substantially only between the first and second positions.

A further embodiment provides a reversible ratchet including a ratchet body having a drive member for applying torque to a workpiece. The ratchet body defines a receptacle. The ratchet includes a rotatable gear positioned in the receptacle and connected to the drive member, and a first pawl and a second pawl positioned adjacent to the gear. The first and second pawls are engageable with the gear. The ratchet includes a reversing mechanism having a cam portion and a lever connected to the cam portion. The cam portion is positioned adjacent to the first and second pawls on a side of the first and second pawls opposite to the gear. The lever is switchable between a first position where the cam portion contacts the first pawl so as to cause the first pawl to engage the gear and a second position where the cam portion contacts the second pawl so as to cause the second pawl to engage the gear. The ratchet also includes a cover plate connected to the ratchet body.

DESCRIPTION OF THE FIGURES

FIG. 7 is a fragmentary side perspective view of the ratchet of FIG. 6.

FIG. 8 is a partial exploded perspective view of the ratchet assembly shown in FIG. 6.

DETAILED DESCRIPTION

Figure 1:
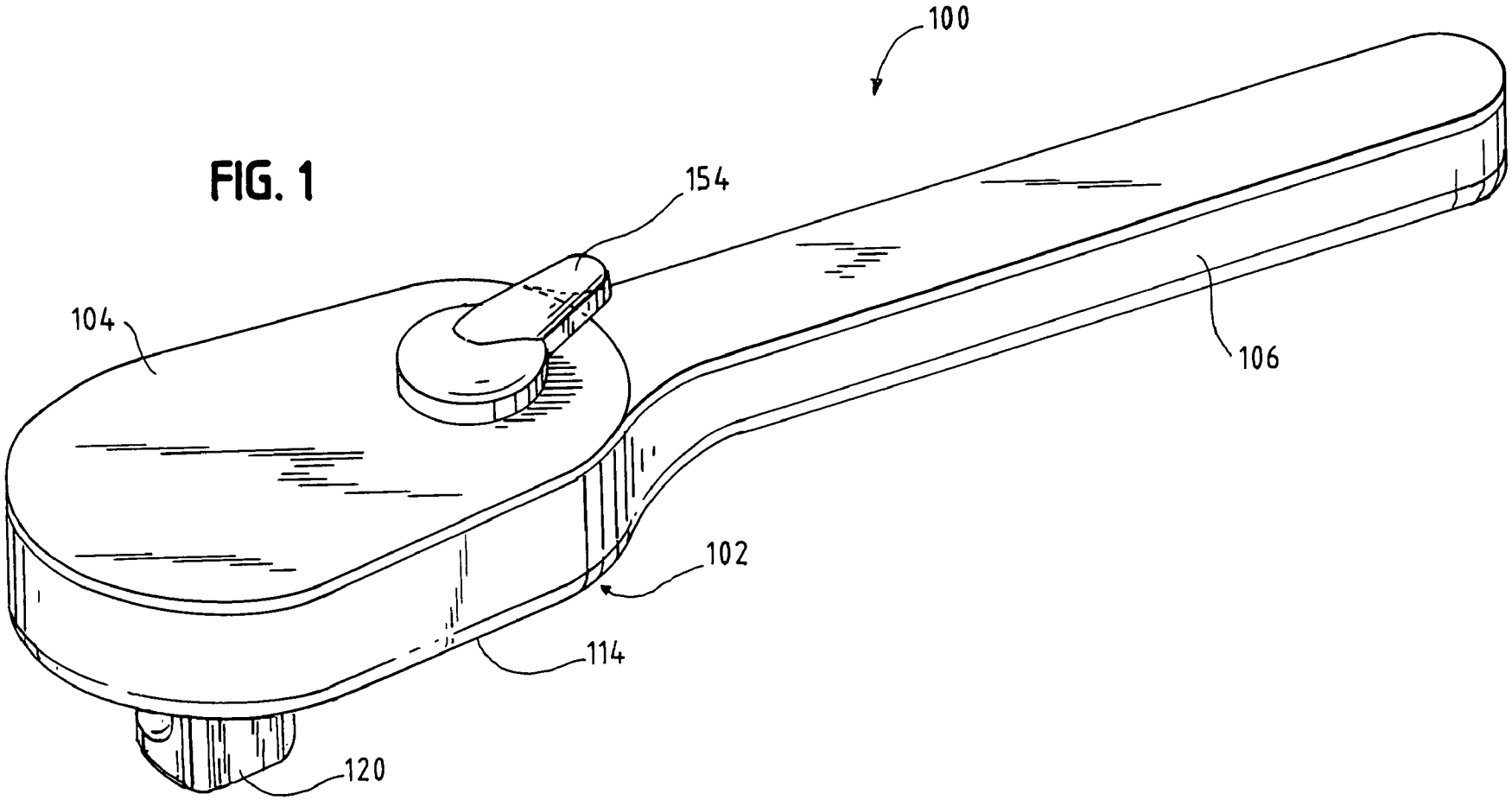
FIG. 1 is a partial top perspective view of one embodiment of the ratchet.

Referring now to FIGS. 1, 2, 3, 4, 5A and 5B, in one embodiment, a reversible ratchet such as a reversible ratchet wrench 100 is provided where the ratchet wrench includes a ratchet body 102. The ratchet body 102 is generally manufactured of a durable material such as a stainless steel to provide strength and integrity to the ratchet wrench. The ratchet body 102 includes a ratchet head 104 and a handle 106 which is connected to the ratchet head. In one embodiment, the ratchet head 104 and handle 106 are integrally formed or manufactured to form the ratchet wrench 100. In another embodiment, the ratchet head 104 and the handle 106 are separate parts or components which are connected together. The ratchet body 102 and more specifically, the ratchet head 104 defines a wall structure 108 having at least one wall defining a cavity or receptacle 110. A ratchet assembly 112 is positioned in the receptacle 110 and is operable to allow the ratchet wrench 100 to ratchet or move in one or more directions.

In the illustrated embodiment, a cover plate 114 is connected to the ratchet body 102 to cover and secure the components of the ratchet assembly in the ratchet wrench 100. The cover plate 114 includes a generally planar body 116 that defines an opening 118 for receiving a drive end 120 described below and a step or receptacle 122. The receptacle 122 extends from one side of the cover plate 114 to a designated distance in the cover plate 114.

The cover plate 114 includes a spacer 124 which is integrally formed with the cover plate. The spacer 124 extends outwardly from a side of the cover plate 114 and is positioned in the cavity or receptacle 110 defined by the body 102 when the cover plate is connected to the body.

A drive mechanism or drive assembly 126 is inserted into the receptacle 110. The drive mechanism 126 transfers torque generated by the ratchet wrench 100 to a work piece. The drive mechanism 126 includes the drive end 120 having drive surfaces 128. In one embodiment, the drive end 128 has a generally square shape which is engageable with a work piece. It should be appreciated that the drive end may be any suitable size or shape. The drive end 128 defines a detent or hole 130. A small bearing or ball 132 is positioned in the hole 130. A spring 134 is positioned in the hole and adjacent to the ball to help to prevent the ball from being removed or fall out of the hole. The spring 134 biases the ball 132 outwardly from the hole 130 to enable a portion of the ball to project from the hole. The ball 132 engages a corresponding detent on one of a plurality of different interchangeable sockets (not shown) connected to the drive end. The sockets have different sizes and shapes to enable the ratchet wrench to engage work pieces having different sizes and shapes. The interchangeable sockets may be any suitable sockets.

The drive mechanism 126 includes a drive gear 136 which is integrally formed with the drive end. The drive gear 136 defines a plurality of teeth 138 on an outer peripheral surface of the gear. The drive mechanism 126 is insertable into the receptacle 110 such that teeth 109 defined by the outer peripheral wall structure 108 are positioned adjacent to an inside surface of the wall structure 103. The gear 136 is rotatably connected to the body 102 and rotatable in a clockwise direction, a counter clockwise direction or in any suitable direction or combination of directions.

A first pawl 140 and a second pawl 142 are positioned in the receptacle 110 adjacent to the drive gear 136. The first and second pawls 140,142 are spaced apart and each include a plurality of teeth which matingly engage the teeth defined by the outer periphery of the drive gear. The first and second pawls 140,142 each have a generally curved shape to correspond to the curvature of the drive gear. The first and second pawls 140, 142 also define a cut out or step 144 and a pivot post 146. Each of the pivot posts 146 are inserted into corresponding receptacles 148 defined by the ratchet body 102. Accordingly, the first and second pawls 140,142 each pivot toward and away from the drive gear 136.

In the illustrated embodiment, a pawl spring 150 is positioned between the first and second pawls 140,142 and is connected to each of the pawls. The pawl spring 150 biases each of the first and second pawls 140,142 into and out of engagement with the gear 136. In one embodiment, the pawl spring 150 is a coil spring. It should be appreciated that the pawl spring may be any suitable spring.

Figure 2:
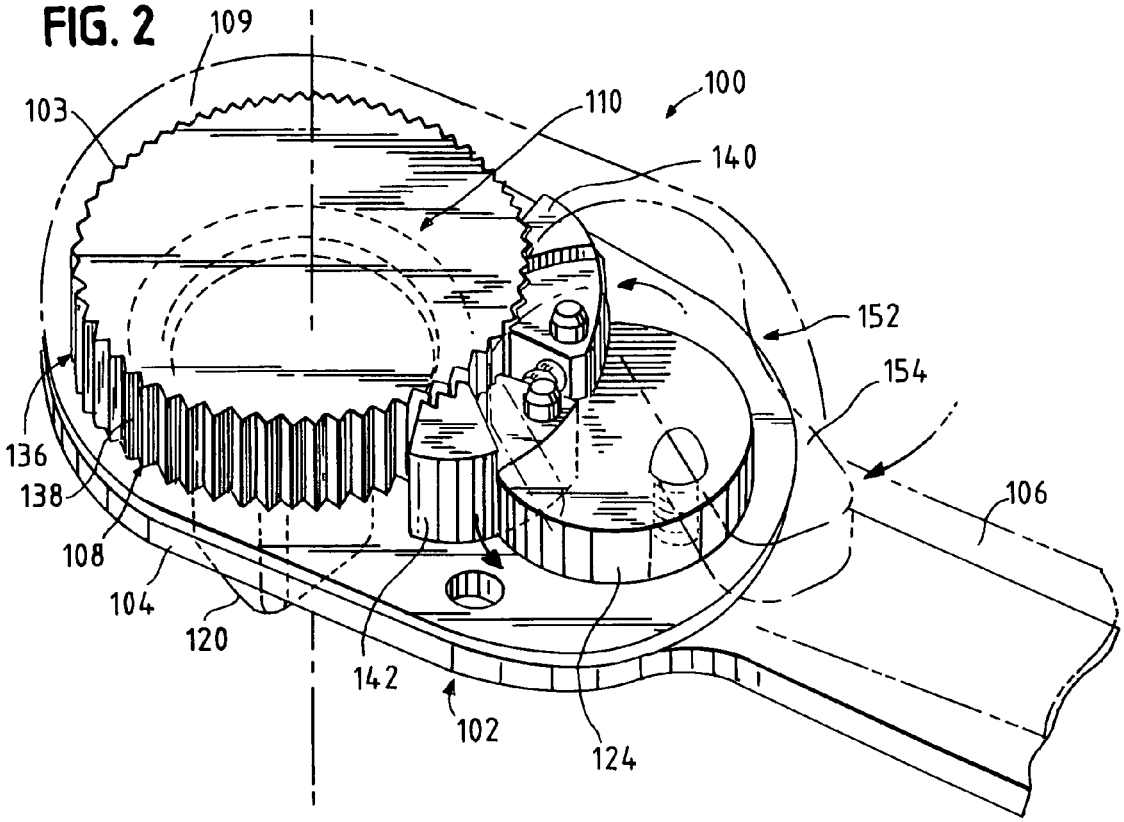
FIG. 2 is a partial top perspective view of one embodiment of the ratchet head shown in FIG. 1.
Figure 3:
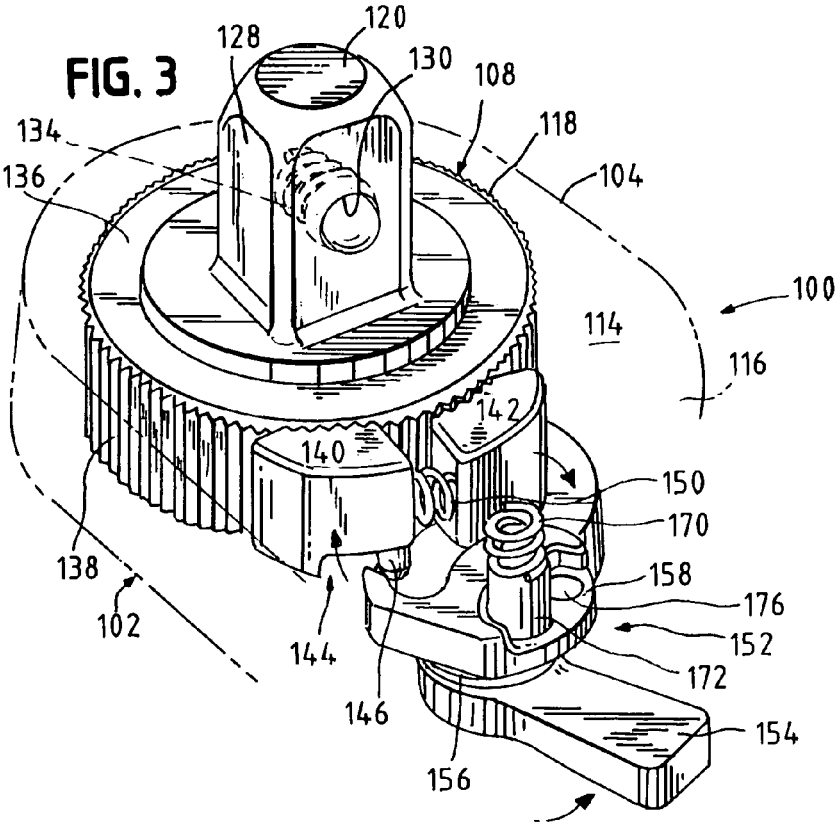
FIG. 3 is a partial bottom perspective view of one embodiment of the ratchet head shown in FIG. 1.
Figure 4:
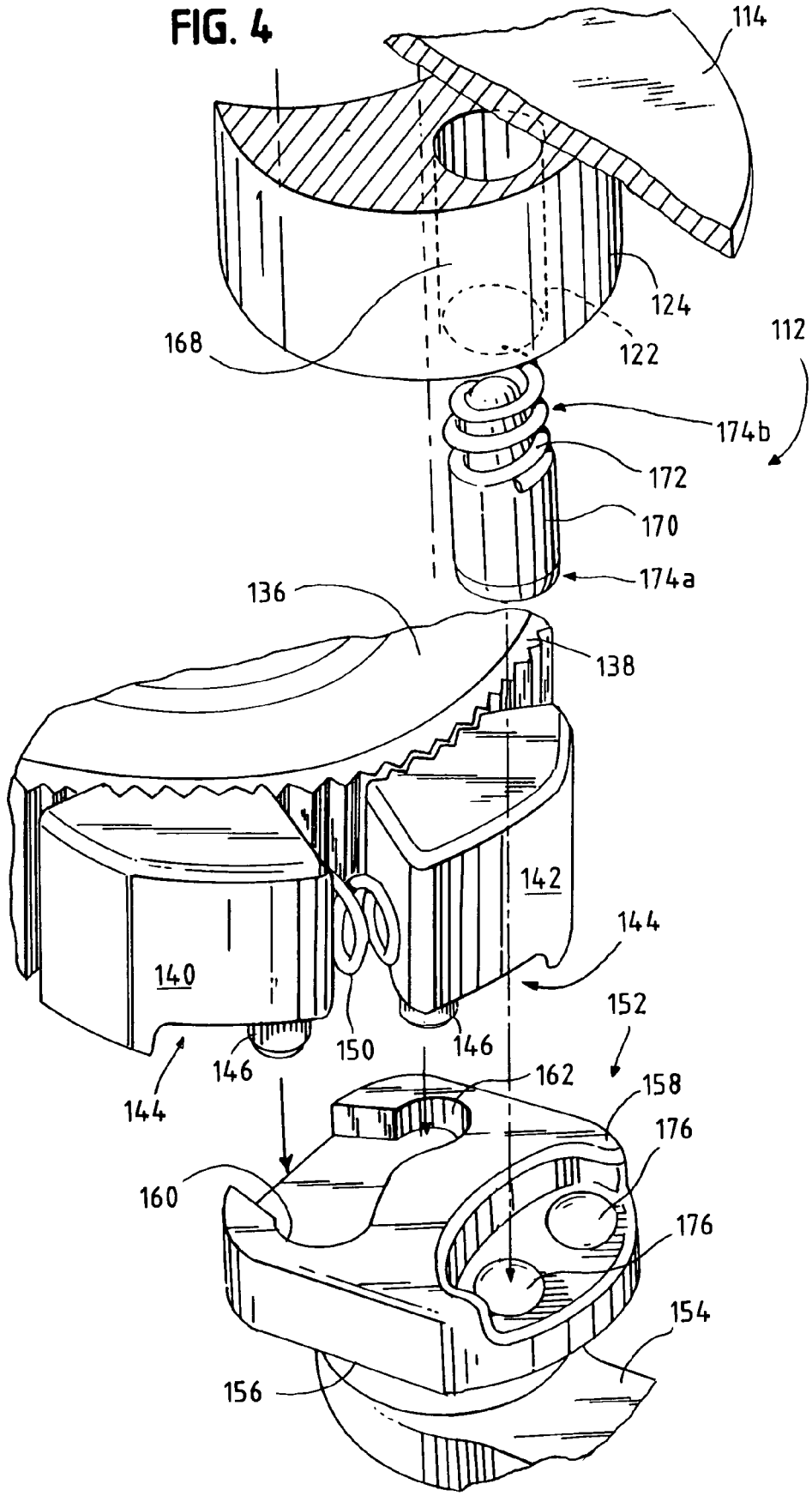
FIG. 4 is a fragmentary exploded perspective view of one embodiment of the ratchet assembly of the ratchet device of FIG. 1 where the spacer is integrally formed with the cover plate.

Referring to FIGS. 2, 3, 4, the ratchet mechanism or ratchet assembly 112 includes a reverse mechanism 152. The reverse mechanism 152 is operable to control the ratcheting direction of the ratchet wrench 100. In one embodiment, the reverse mechanism 152 includes a lever 154, a shaft 156 connected to the lever, and a toggle member 158 connected to the shaft. In one embodiment, the lever 154, shaft 156 and toggle member 158 are integrally connected to form the reverse mechanism 152. In assembly, the integrally formed reverse mechanism 152 is sized to be inserted into the receptacle 110 and manipulated so that the lever 154 is inserted through an opening defined by the ratchet body and is positioned on the exterior of the ratchet body. As further described below, the spacer 124 is positioned adjacent to the reverse mechanism 152 when the cover plate 114 is connected to the ratchet body 102 to minimize the movement of the reverse mechanism within the receptacle. The integrally formed reverse mechanism minimizes the number of parts needed to assembly the ratchet wrench and thereby minimizes manufacturing costs and assembly time of the ratchet wrench.

In one embodiment, the toggle member 158 rotates or moves concurrently with the movement of the lever 154. For example, if the lever 154 is rotated in a clockwise direction, the toggle member 158 correspondingly moves in a clockwise direction. In the illustrated embodiment, the toggle member 158 defines two cam surfaces 160, 162. One of the cam surfaces 160 engages the first pawl 140 and the other cam surface 162 engages the second pawl 142. Specifically, the first cam surface 160 engages the first pawl 150 to direct the first pawl into engagement with the gear 136. The second cam surface 162 engages the second pawl 142 to direct the second pawl into engagement with the gear 136.

Figure 5A:
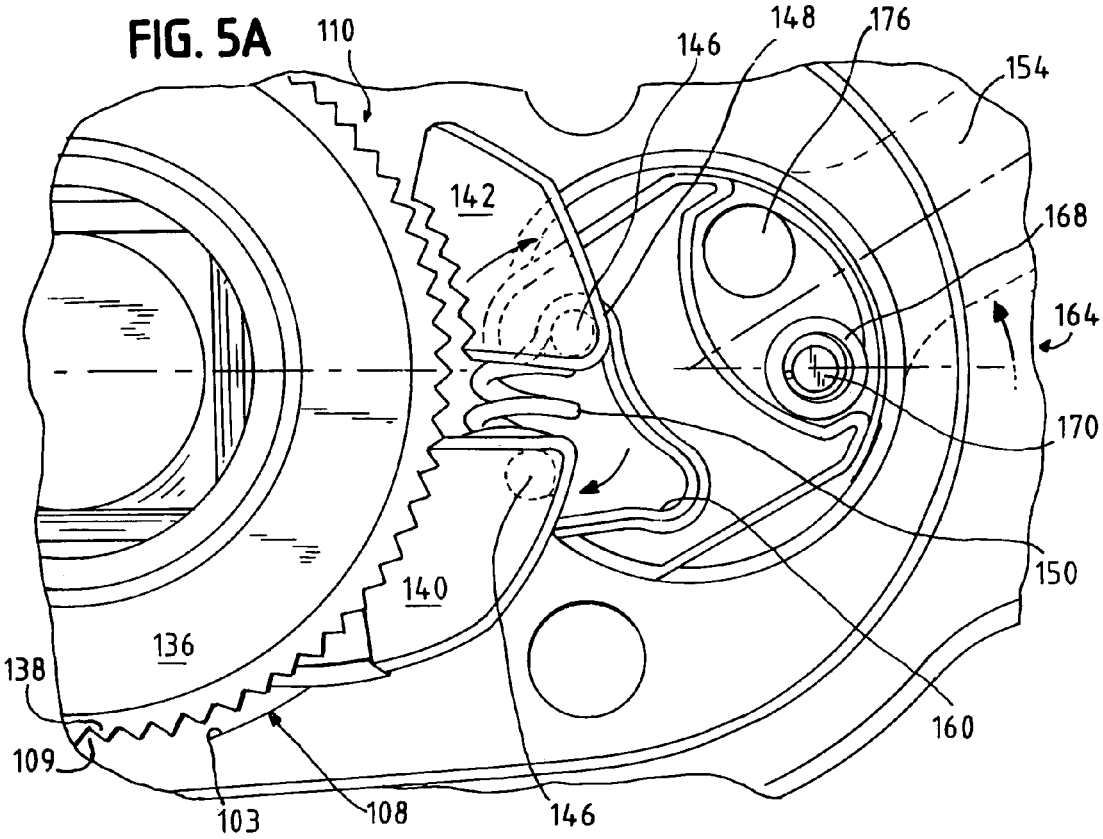
FIG. 5A is an enlarged fragmentary top view of the ratchet assembly of FIG. 3 illustrating a first pawl engaged with the gear.
Figure 5B:
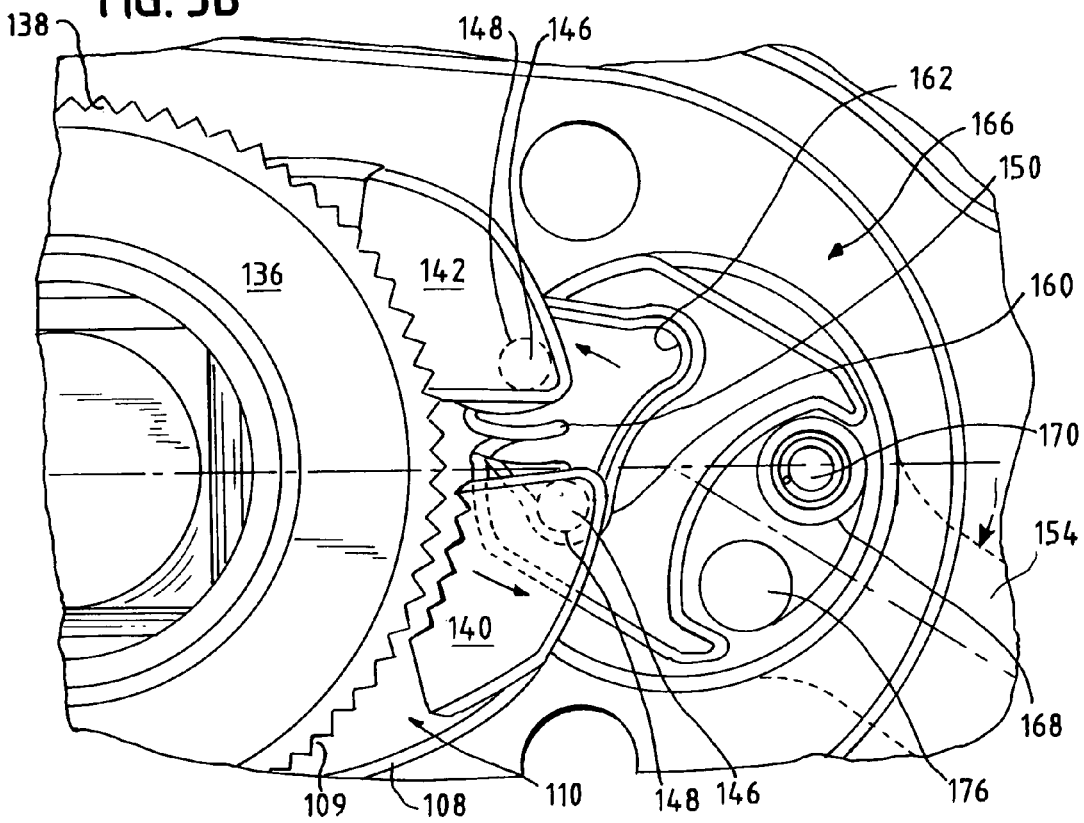
FIG. 5B is an enlarged fragmentary top view of the ratchet assembly of FIG. 3 illustrating a second pawl engaged with the gear.

Referring to FIGS. 5A and 5B, the lever 154 is movable or switchable between a first position 164 and a second position 166. When the lever 154 is moved to the first position 164, the first pawl 140 engages or contacts gear 136. The pawl spring 150 causes the second pawl 142 to disengage from or move away from the gear 136. Therefore, only one of the pawls 140, 142 is engaged with the gear 136 at a time. This enables the ratchet wrench 100 to rotate or ratchet in a one direction and reduces the likelihood of the ratchet binding or locking up during use.

After the drive mechanism 126 and reverse mechanism 152 are inserted into the receptacle 110, the cover plate 114 is connected to the ratchet body 102 to secure the ratchet components in the body. The spacer 124 fills the void or gap between the top of the reverse mechanism and the cover plate as described above to help maintain the positions of the components and specifically, the reverse mechanism 152 in the receptacle 110.

The spacer 124 defines a channel or receptacle 168 which is adapted to receive a plunger 170 and a spring 172. The plunger 170 has a generally cylindrical shape and two ends 174*a* and 174*b*. One of the ends, 174*a*, includes a tapered surface and the other opposing end, 174*b*, defines a small post or pin. The coil spring 172 is positioned between the plunger 170 and the inside surface of the cover plate 114 (when the cover plate is connected to the body) to bias the plunger towards the reverse mechanism 152. As shown in the illustrated embodiment, the toggle member 158 defines a plurality of detents or divots 176. The beveled or tapered surface of the end 174*a* of the plunger 170 corresponds to the shape of the detents or divots 176 of the toggle member. This allows the tapered surface 174*a* to engage the detents 176 and temporarily hold the plunger 170 in place and correspondingly hold the reverse mechanism 152 in position. The tapered surface of end 174*a* also allows the plunger to move out of one detent and into the other detent when a designated manual force is applied to the reverse mechanism 152.

Figure 6:
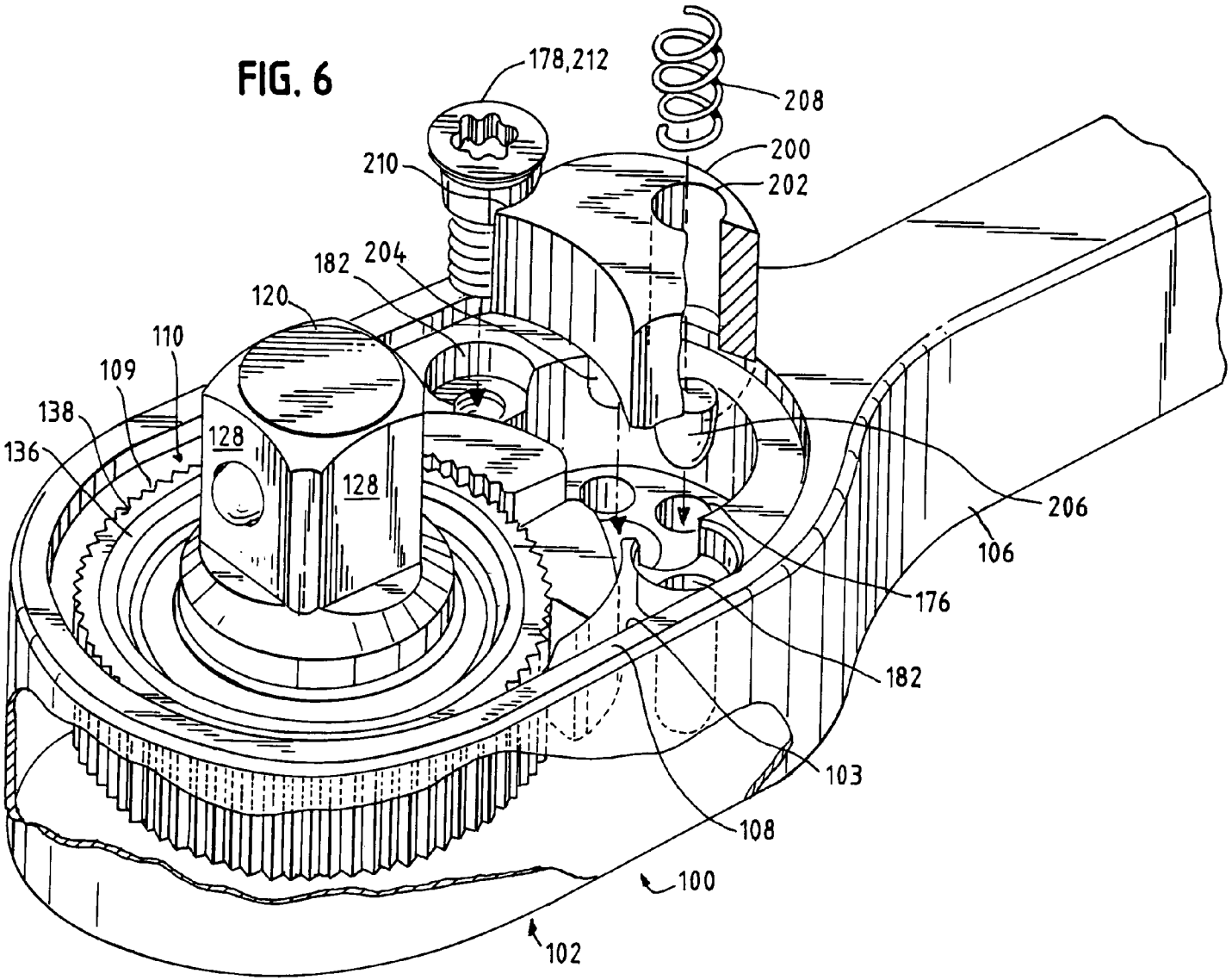
FIG. 6 is a partial exploded perspective view of another embodiment of the ratchet where the cover plate is removed from the ratchet.
Figure 9A:
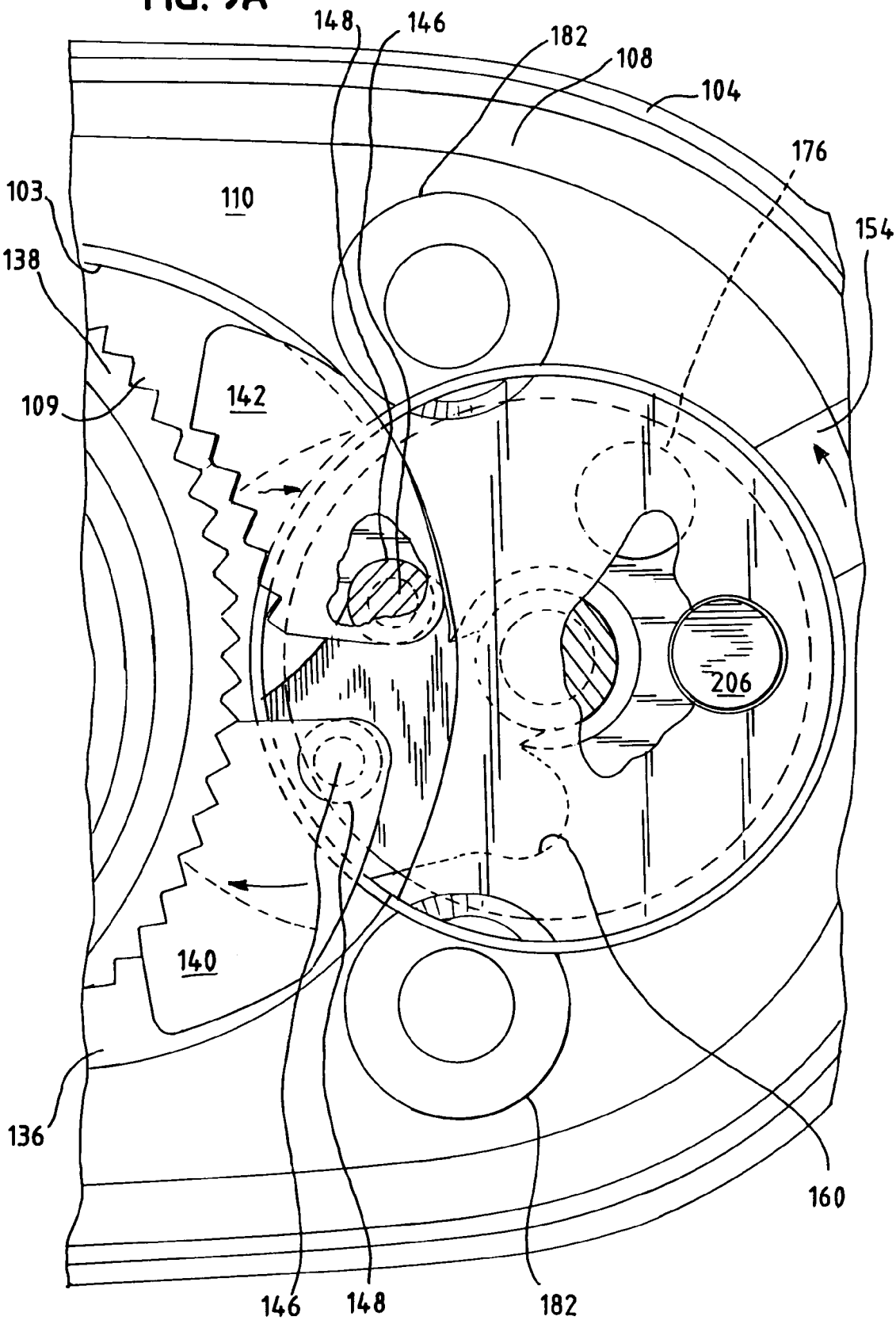
FIG. 9A is an enlarged fragmentary top view of the ratchet assembly shown in FIG. 6 illustrating a first pawl engaged with the gear.
Figure 9B:
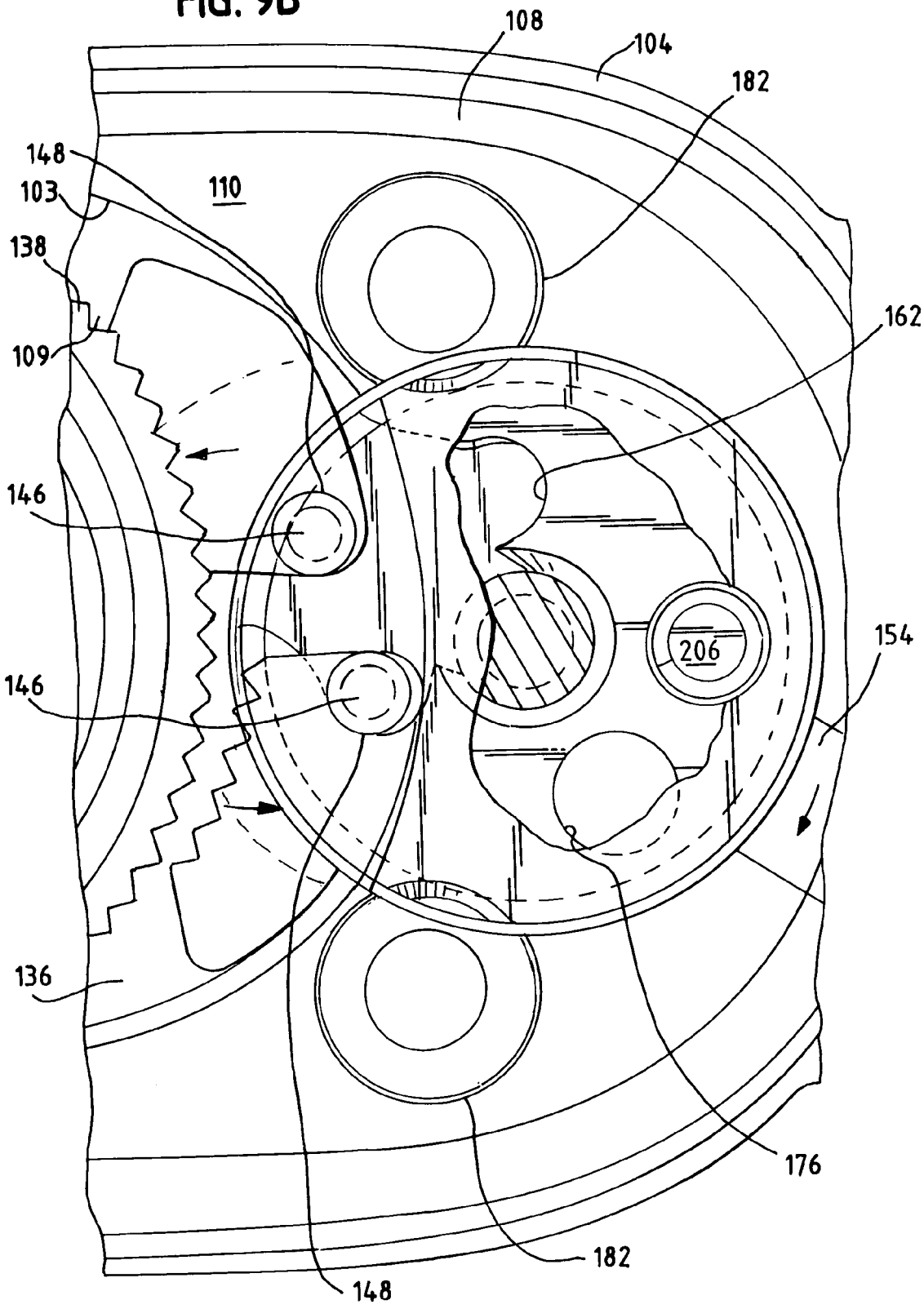
FIG. 9B is an enlarged fragmentary top view of the ratchet assembly shown in FIG. 6 illustrating a second pawl engaged with the gear.

The cover plate 114 is secured to the ratchet body 102 using connectors such as screws 178 shown in FIG. 6, which are insertable through openings 179 defined in the cover plate and along grooves 180 defined by the spacer. Each of the screws 178 engage a corresponding cup or receptacle 182 defined by the ratchet body 102.

As described above, the spacer 124 fills the void or gap between the top of the reverse mechanism 152 and the cover plate 114. This helps to prevent the reverse mechanism or other components of the ratchet wrench 100 from becoming loose or breaking. The spacer 124 also secures the reverse mechanism 152. Specifically, the spacer 124 engages the reverse mechanism to allow movement of the reverse mechanism substantially only between the first and second positions 164, 166. In the illustrated embodiment, all of the components of the ratchet wrench 100 are insertable from one side of the ratchet wrench. This makes assembly of the wrench easier and more efficient during manufacturing.

Referring now to FIGS. 6, 7, 8, 9A and 9B, in another embodiment, the ratchet 100 includes a spacer 200 that is manufactured as a separate component and independently inserted into the receptacle 110 defined by the ratchet body 102. In this embodiment, the spacer 200 defines an opening, receptacle or channel 202 that extends from one side of the spacer to the other side of the spacer. A post 204 maintains the position of the spacer 200 relative to the reverse mechanism 152. As described above, a plunger 206 and a spring 208 are positioned in the channel 202 defined by the spacer. The spring 208 biases the plunger 206 towards the reverse mechanism 152 and more specifically, into one of the detents 176 of the reverse mechanism. The spacer therefore engages the reverse mechanism to allow movement of the reverse mechanism substantially only between the first and second positions 164, 166 described above. The spacer 200 defines two grooves 210 which are sized to receive the connectors or screws 212. The connectors or screws 212 are positioned adjacent to the spacer 200 and connect the cover plate 114 to the ratchet body 102.

It should be appreciated that the components of the ratchet wrench 200 described above are made of stainless steel. It should also be appreciated that the components of the ratchet wrench 100 may be made out of any suitable material or materials.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A reversible ratchet comprising:

a ratchet body having a drive member for applying torque to a workpiece, the ratchet body defining a receptacle having an opening;

a ratchet assembly disposed in the receptacle, the ratchet assembly including a rotatable gear, a first pawl and a second pawl, the first and second pawls being engageable with the gear;

a reverse lever coupled to the first and second pawls and movable between a first position and a second position, the first pawl engaging the gear in the first position of the reverse lever, and the second pawl engaging the gear in the second position of the reverse lever; and a cover plate connected to the ratchet body and covering at least a portion of the opening, the cover plate including a spacer engaging the reverse lever to allow movement of the reverse lever substantially only between the first and second positions, wherein the spacer is disposed at least partially within the receptacle.

2. The ratchet of claim 1, further comprising a plunger and a spring, the spacer defining a channel for receiving the plunger and the spring, the spring being positioned between the plunger and the cover plate so as to bias the plunger into engagement with the reverse lever.

3. The ratchet of claim 1, further comprising a plunger and a spring, the spacer defining a channel for receiving the plunger and the spring and the reverse lever defining a plurality of detents, the spring being positioned between the plunger and the cover plate so as to bias the plunger into engagement with at least one of the detents defined by the reverse lever.

4. The ratchet of claim 1, wherein the cover plate is integrally formed with the spacer.

5. The ratchet of claim 1, wherein the spacer defines at least one groove, the groove adapted to receive a connector to secure the cover plate to the ratchet body.

6. The ratchet of claim 1, wherein the spacer defines a plurality of the grooves, each of the grooves adapted to receive a connector for securing the cover plate to the ratchet body.

7. A reversible ratchet comprising:

a ratchet body having a drive member for applying torque to a workpiece, the ratchet body including a peripheral wall structure defining a receptacle and an opening;

a rotatable gear positioned in the receptacle, the gear defining a plurality of gear teeth;

a first pawl and a second pawl positioned adjacent to the gear in the receptacle, each of the first and second pawls including a plurality of pawl teeth adapted to matingly engage the gear teeth;

a reverse lever coupled to the first and second pawls and movable between a first position and a second position, the first pawl engaging the gear in the first position of the reverse lever, and the second pawl engaging the gear in a second position of the reverse lever;

a cover plate connected to the ratchet body and covering at least a portion of the opening; and a spacer positioned between the cover plate and the reverse lever, the spacer engaging the reverse lever to substantially limit movement of the reverse lever to rotational movement substantially between the first and second positions, the spacer at least partially disposed within the receptacle, and the cover plate being integral with the spacer.

8. The ratchet of claim 7, further comprising a plunger and a spring, the spacer defining a channel for receiving the plunger and the spring, the spring being positioned between the plunger and the cover plate so as to bias the plunger into engagement with the reverse lever.

9. The ratchet of claim 7, further comprising a plunger and a spring, the spacer defining a channel for receiving the plunger and the spring and the reverse lever defining a plurality of detents, the spring being positioned between the plunger and the cover plate so as to bias the plunger into engagement with at least one of the detents defined by the reverse lever.

10. The ratchet of claim 7, wherein the spacer defines at least one groove, the groove adapted to receive a connector for securing the cover plate to the ratchet body.

11. The ratchet of claim 7, wherein the spacer defines a plurality of grooves, each of the grooves adapted to receive a connector for securing the cover plate to the ratchet body.

12. A reversible ratchet comprising:

a ratchet body having a drive member for applying torque to a workpiece, the ratchet body defining a receptacle;

a rotatable gear positioned in the receptacle and connected to the drive member, a first pawl and a second pawl positioned adjacent to the gear, the first and second pawls engageable with the gear;

a cover plate connected to the ratchet body; and a reversing mechanism having a cam portion and a lever connected to the cam portion, the cam portion positioned adjacent to the first and second pawls on a side of the first and second pawls opposite to the cover plate, the lever being switchable between a first position where the cam portion contacts the first pawl so as to cause the first pawl to engage the gear and a second position where the cam portion contacts the second pawl so as to cause the second pawl to engage the gear.

13. The ratchet of claim 12, wherein the cover plate includes a spacer engaging the reverse lever to allow movement of the reverse lever in substantially only between the first and second positions.

14. The ratchet of claim 12, wherein the cover plate includes a spacer integrally formed with the cover plate, the spacer engaging the reverse lever to allow movement of the reverse lever in substantially only between the first and second positions.

15. The ratchet of claim 12, further comprising a plunger and a spring, the spacer defining a channel for receiving the plunger and the spring, the spring being positioned between the plunger and the cover plate so as to bias the plunger into engagement with the reverse lever.

16. The ratchet of claim 12, further comprising a plunger and a spring, the spacer defining a channel for receiving the plunger and the spring and the reverse lever defining a plurality of detents, the spring being positioned between the plunger and the cover plate so as to bias the plunger into engagement with at least one of the detents defined by the reverse lever.

17. The ratchet device of claim 12, wherein the spacer defines at least one groove, the groove adapted to receive a connector for securing the cover plate to the ratchet body.

18. The ratchet device of claim 12, wherein the spacer defines a plurality of grooves, each of the grooves adapted to receive a connector for securing the cover plate to the ratchet body.

* * * * *